US008045747B2

(12) United States Patent
Gu

(10) Patent No.: US 8,045,747 B2
(45) Date of Patent: Oct. 25, 2011

(54) BI-DIRECTIONAL LOUDSPEAKER

(76) Inventor: Dai-Meng Gu, Dongguan (CN)

( * ) Notice: Subject to any disclaimer, the term of this patent is extended or adjusted under 35 U.S.C. 154(b) by 333 days.

(21) Appl. No.: 12/457,794

(22) Filed: Jun. 22, 2009

(65) Prior Publication Data

US 2010/0322461 A1 Dec. 23, 2010

(51) Int. Cl.
*H04R 25/00* (2006.01)

(52) U.S. Cl. ..... 381/416; 381/412; 381/432

(58) Field of Classification Search ..... 381/386, 381/396, 398, 403, 404, 412, 416, 419, 420, 381/421, 432, 433
See application file for complete search history.

(56) References Cited

U.S. PATENT DOCUMENTS 4,737,992 A * 4/1988 Latham-Brown et al. .... 381/404
5,802,191 A * 9/1998 Guenther ..... 381/386
7,016,514 B2 * 3/2006 White et al. ..... 381/397

* cited by examiner

*Primary Examiner* — Huyen D Le

(57) ABSTRACT

A thin and cost-effective bi-directional loudspeaker which can reproduce high quality sound toward contrary directions simultaneously, arranged from bottom to the top, consists of a frame (2), a U-yoke (3), a first magnet (4), a washer (5), a copper cap (6), a second magnet (7), a voice coil (8), a diaphragm (9), a spacer (12), a spider (15), a dust cap (18) and a connector (1) disposed on lateral side of the frame (2). Said loudspeaker is characterized in that: said diaphragm (9) is in a cone shape whose an inner edge (10) of said apex is fixed with top of said voice coil (8). A periphery (16) of the spider (15) is fixed with an upper edge (14) of the supporting ring (12) and a bottom edge (13) thereof is fixed with an exterior (11) of the diaphragm (9). Said spider (15), spacer (12) and diaphragm (9) are coupled by adhesive and fixed on top of said frame (2).

8 Claims, 4 Drawing Sheets

BI-DIRECTIONAL LOUDSPEAKER

FIELD OF THE INVENTION

The present invention relates to a loudspeaker which can reproduce sound from two contrary directions

BACKGROUND OF THE INVENTION

A loudspeaker, also called speaker, is an acoustic transducer which can transform electronic signal into sound wave and be transmitted. Loudspeaker is a common device which is often incorporated in most electronic devices for outputting sound. Sizes of loudspeaker are variable, from a small size for use of earphone, headset or mobile phone to a super size for use of music concerts or movie theaters, giving the loudspeaker a wide range of application.

A conventional loudspeaker usually consists of a frame; and a U-yoke is secured directly on the bottom thereof. Inside the frame, a magnet, a washer, a voice coil and a dust cap are arranged following such order; and a diaphragm is coupled with the upper edge of the frame and a spider usually set on the bottom of the diaphragm. With opening of the diaphragm facing upwardly as a shape of a funnel, said configuration of the traditional loudspeaker may produce distortion and reduce the quality of the sound.

Moreover, said configuration limits the size of loudspeaker and produces higher friction which degrades the quality of the sound, and higher cost for manufacture; the application range of the speaker is therefore reduced.

SUMMARY OF THE INVENTION

For improving the prior art and resolving the defects aforementioned, a bi-directional loudspeaker having smaller size and better quality of sound is provided. Said loudspeaker includes a frame (2); a spider (15) having waving surface and a hole in the centre, is mounted on a top of said frame (2); a supporting ring (12) fitted onto an exterior of said spider (15); a diaphragm (9) is disposed between the frame (2) and the spider (15); a U-yoke (3) is disposed between the frame (2) and diaphragm (9); a voice coil (8) having one end thereof fitted into the U-yoke (3), is disposed between the diaphragm (9) and the U-yoke (3); a first magnet (4), a washer (5), a copper cap (6) and a second magnet (7) are arranged in above order and incorporated between said U-yoke (3) and voice coil (8); a dust cap (18) mounted on a top of the diaphragm (9); and a connector (1) for providing signal input is disposed on a side of the frame (2) and electrically connected with said voice coil (8).

Said bi-directional loudspeaker is characterized in that: said diaphragm (9) is in a shape of a cone whose a wider opening is facing downwardly, and an apex penetrates a centre of the spider (15). An inner edge (10) of said apex is fixed with a top of said voice coil (8). A periphery (16) of the spider (15) is fixed with an upper edge (14) of the supporting ring (12), and a bottom edge (13) thereof is fixed with an exterior (11) of the diaphragm (9). Said spider (15), spacer (12) and diaphragm (9) are coupled by adhesive and fixed on top of said frame (2).

Said loudspeaker can also have a frame (2); a spider (15) having waving surface and a hole in the centre, is mounted on a top of said frame (2); a housing (19) is disposed on an exterior of said spider (15) for covering the frame (2) and retaining said spider (15); a diaphragm (9) is disposed between the frame (2) and the spider (15); a U-yoke (3) is disposed between the frame (2) and diaphragm (9); a voice coil (8) having one end thereof fitted into the U-yoke (3), is disposed between the diaphragm (9) and the U-yoke (3); a first magnet (4), a washer (5), a copper cap (6) and a second magnet (7) are arranged in above order and incorporated between said U-yoke (3) and voice coil (8); a dust cap (18) mounted on a top of the diaphragm (9); and a connector (1) for providing signal input is disposed on a side of the frame (2) and electrically connected with said voice coil (8).

This type of speaker is characterized in that said diaphragm (9) is in a shape of a cone whose wider opening is facing downwardly, and an apex penetrates a centre of the spider (15). An inner edge (10) of said apex is fixed with a top of said voice coil (8). A periphery (16) of the spider (15) is fixed with an upper locating hole (20) of the housing (19) and each lateral side of bottom thereof is fixed with an each side of exterior (11) of the diaphragm (9). Said spider (15), spacer (12) and diaphragm (9) are coupled by adhesive and fixed on the top of said frame (2). An inner edge (17) of the spider (15) is jointed with said diaphragm (9).

Said first magnet (4) and washer (5) aforementioned in either type of said bi-directional loudspeakers are fitted into said copper cap (6) by having the washer (5) set on top of the first magnet (4), and the second magnet (7) is disposed on top of said copper cap (6). Said first and second magnet (4, 7) are neodymium magnets (NdFeB magnet).

COMPARISON WITH THE PRIOR ART

In accordance with said embodiments, the present invention is provided with following advantages:

1. Contrary to the conventional loudspeaker placing the diaphragm as a funnel, the diaphragm (9) of the present invention is positioned reversely which covers the voice coil (8) and U-yoke (3), reducing the thickness significantly; and with the spider (15) placing on top of the diaphragm (9), the present invention is allowed to emit sound wave toward the front and rear simultaneously. Such concept provides more realistic sound, and smaller size extends the application range of the invention.
2. With lower damping, the sound quality is improved evidently and by adapting with other accessories such as sound-box, the quality and power of output can be provided to the maximum.

DETAIL DESCRIPTION OF PREFERRED EMBODIMENTS

The description of preferred embodiments are described in detail according to appended drawings hereinafter.

First Embodiment

Figure 1:
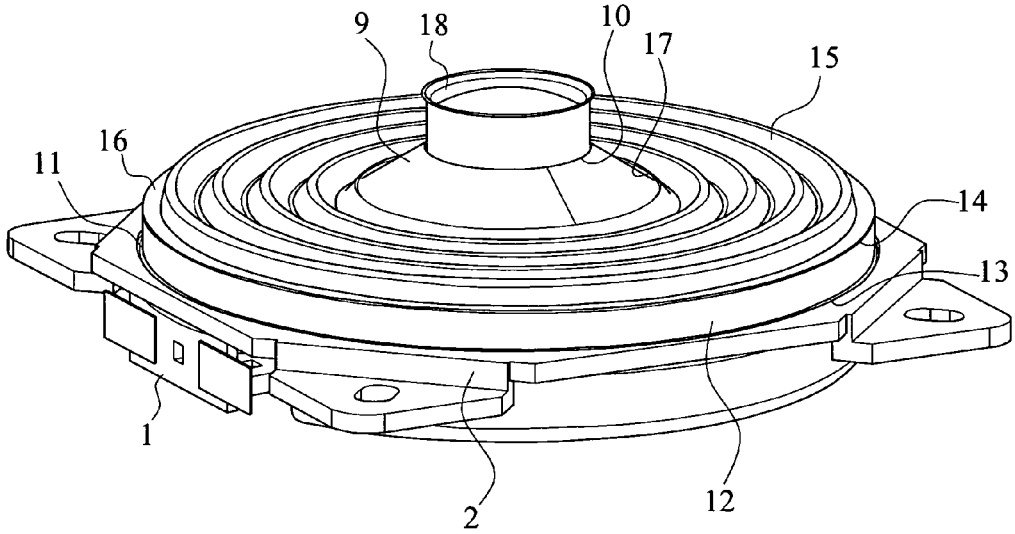
FIG. 1 is a schematic diagram of the first embodiment of the present invention.
Figure 2:
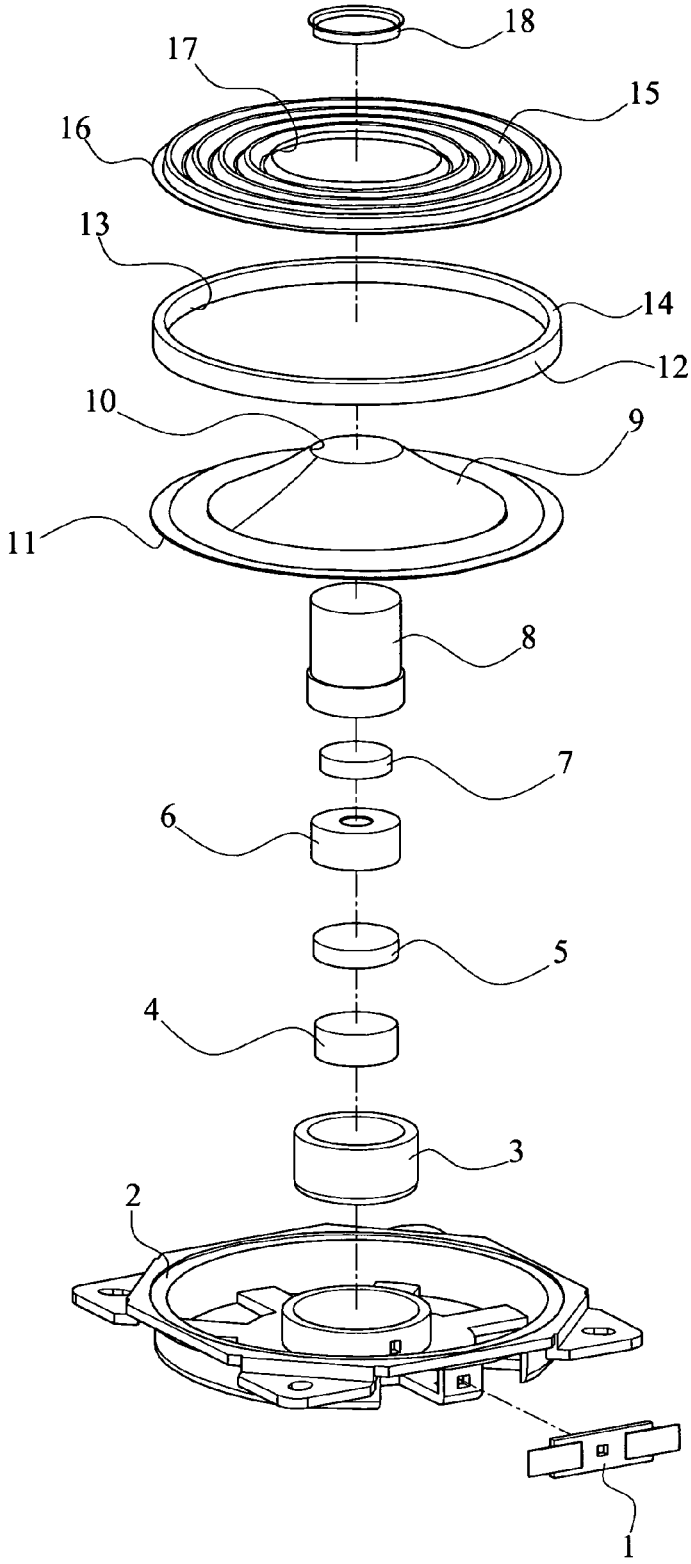
FIG. 2 is an exploded view of the first embodiment of the present invention.

As shown in FIGS. 1 and 2, a bi-directional loudspeaker consists essentially of: a frame (2); a spider (15) having waving surface and a hole in the centre, is mounted on a top of said frame (2); a supporting ring (12) fitted onto an exterior of said spider (15); A diaphragm (9) is disposed between the frame (2) and the spider (15); A U-yoke (3) is disposed between the frame (2) and diaphragm (9); A voice coil (8) having one end thereof fitted into the U-yoke (3), is disposed between the diaphragm (9) and the U-yoke (3).

A first magnet (4), a washer (5), a copper cap (6) and a second magnet (7) are arranged in above order and incorporated between said U-yoke (3) and voice coil (8).

A dust cap (18) mounted on a top of the diaphragm (9); and a connector (1) for providing signal input is disposed on a side of the frame (2) and electrically connected with said voice coil (8). Said bi-directional loudspeaker is characterized in that: said diaphragm (9) is in a cone shape, a wider opening is facing downwardly and an apex penetrates a centre of the spider (15); an inner edge of said apex is fixed with a top of said voice coil (8); a periphery (16) of the spider (15) is fixed with an upper edge (14) of the supporting ring (12) and a bottom edge (13) thereof is fixed with an exterior (11) of the diaphragm (9); Said spider (15), spacer (12) and diaphragm (9) are coupled by adhesive and fixed on the top of said frame (2).

With wider opening of the diaphragm (9) facing downwardly, said U-yoke (3) and voice-coil (8) are fitted into the diaphragm (9), reducing the depth of the invention evidently. Furthermore, the spider (15), placing on top of the diaphragm (9) allows the present invention emit sound wave toward the front and rear simultaneously. The concept of a bi-directional loudspeaker improves the sound quality and smaller size extends the application range of the invention.

Second Embodiment

Figure 3:
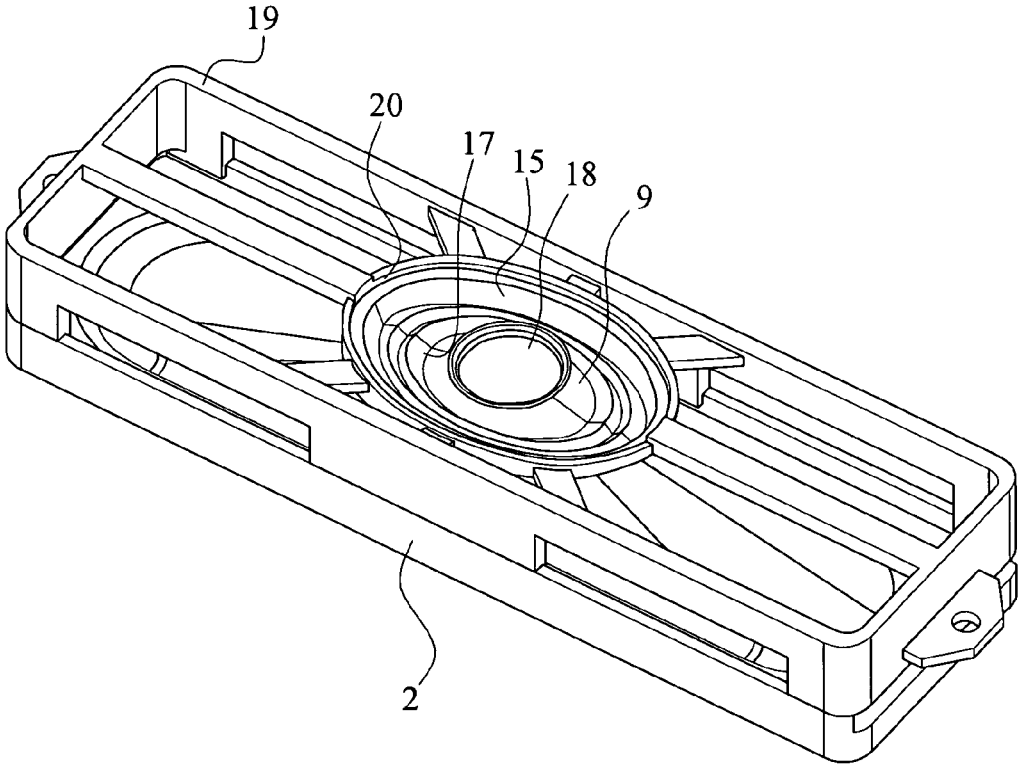
FIG. 3 is a schematic diagram of the second embodiment of the present invention.
Figure 4:
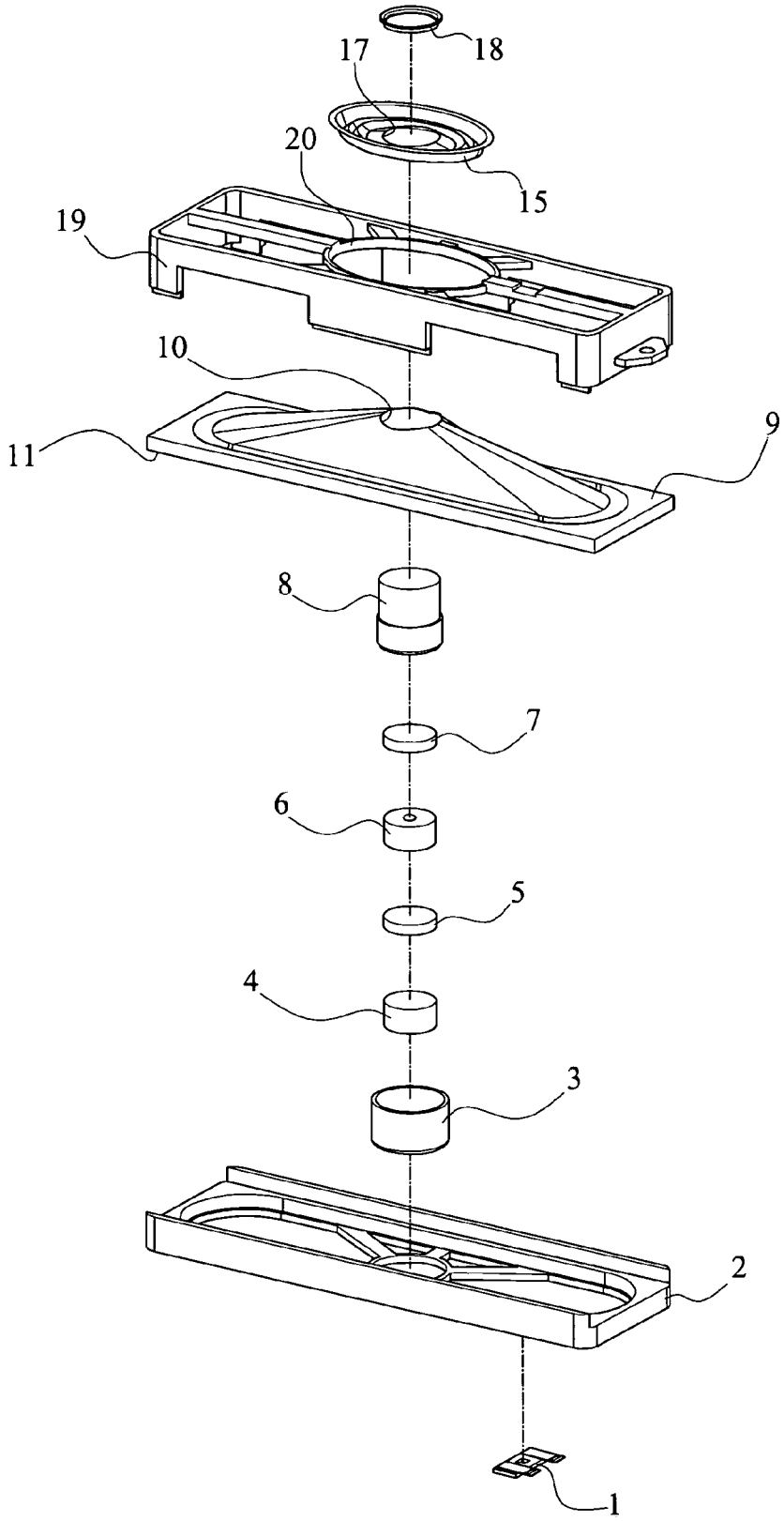
FIG. 4 is an exploded view of the second embodiment of the present invention.

Referring to FIGS. 3 and 4 are the second embodiment of the present invention. A bi-directional loudspeaker as disclosed in the second embodiment comprises: a frame (2); a spider (15) having waving surface and a hole in the centre, is mounted on a top of said frame (2); a housing (19) is disposed on an exterior of said spider (15) for covering the frame (2) and retaining said spider (15); a diaphragm (9) is disposed between the frame (2) and the spider (15); a U-yoke (3) is disposed between the frame (2) and diaphragm (9); a voice coil (8) having one end thereof fitted into the U-yoke (3), is disposed between the diaphragm (9) and the U-yoke (3); a first magnet (4), a washer (5), a copper cap (6) and a second magnet (7) are arranged in above order and incorporated between said U-yoke (3) and voice coil (8); a dust cap (18) mounted on a top of the diaphragm (9); and a connector (1) for providing signal input is disposed on a side of the frame (2) and electrically connected with said voice coil (8). Said loudspeaker is characterized in that: said diaphragm (9) is in a cone shape, a wider opening is facing downwardly and an apex penetrates a centre of the spider (15); an inner edge of said apex is fixed with a top of said voice coil (8); a periphery (16) of the spider (15) is fixed with an upper locating hole (20) of the housing (19) and each lateral side of bottom thereof is fixed with an each side of exterior (11) of the diaphragm (9); Said spider (15), spacer (12) and diaphragm (9) are coupled by adhesive and fixed on the top of said frame (2) is different from the first for having housing (19) to cover the voice coil (8) and U-yoke (3).

The aforementioned first embodiment can function by adapting other accessories (e.g. sound box) while the invention disclosed in the second embodiment can be use as a loudspeaker directly.

Both embodiments have a first magnet (4) and a washer (5) arranged with such order and fitted into the copper cap (6); and a second magnet (7) disposed on the top of said copper cap (6). By the specific arrangement, the loudspeaker is provided with better quality of sound and the lower noise. Said first and second magnet (4,7) are neodymium magnets (Nd-FeB magnet), the election is made for its light weight and high magnetic energy.

In both embodiments, an inner edge (17) of the spider (15) is jointed with said diaphragm (9). The configuration of the spider (15) can stabilize both directions of sound wave and lower the interference.

What is claimed:

1. A bi-directional loudspeaker comprising:

A frame (2);

A spider (15), having a waving surface and a hole in the centre, is mounted on a top of said frame (2);

A supporting ring (12) fitted onto an exterior of said spider (15);

A diaphragm (9) is disposed between the frame (2) and the spider (15);

A U-yoke (3) is disposed between the frame (2) and diaphragm (9);

A voice coil (8) having one end thereof fitted into the U-yoke (3), is disposed between the diaphragm (9) and the U-yoke (3);

A first magnet (4), a washer (5), a copper cap (6) and a second magnet (7) are arranged in above order and incorporated between said U-yoke (3) and voice coil (8);

A dust cap (18) mounted on a top of the diaphragm (9); and

A connector (1) for providing signal input is disposed on a side of the frame (2) and electrically connected with said voice coil (8); said bi-directional loudspeaker is characterized in that:

Said diaphragm (9) is in a cone shape whose a wider opening is facing downwardly and an apex penetrates a centre of the spider (15); an inner edge (10) of said apex is fixed with a top of said voice coil (8); a periphery (16) of the spider (15) is fixed with an upper edge (14) of the supporting ring (12) and a bottom edge (13) hereof is fixed with an exterior (11) of the diaphragm (9); Said spider (15), spacer (12) and diaphragm (9) are coupled by an adhesive and fixed on the top of said frame (2).

2. A bi-directional loudspeaker of claim 1, wherein said first magnet (4) and washer (5) are fitted into said copper cap (6) by above arrangement and the second magnet (7) is disposed on a top of said copper cap (6).

3. A bi-directional loudspeaker of claim 1, wherein said first and second magnet (4, 7) are neodymium magnets (Nd-FeB magnet).

4. A bi-directional loudspeaker of claim 1, wherein an inner edge (17) of the spider (15) is jointed with said diaphragm (9).

5. A bi-directional loudspeaker comprising:

A frame (2);

A spider (15) having waving surface and a hole in the centre, is mounted on a top of said frame (2);

A housing (19) is disposed on an exterior of said spider (15) for covering the frame (2) and retaining said spider (15);

A diaphragm (9) is disposed between the frame (2) and the spider (15);

A U-yoke (3) is disposed between the frame (2) and diaphragm (9);

A voice coil (8) having one end thereof fitted into the U-yoke (3), is disposed between the diaphragm (9) and the U-yoke (3);

A first magnet (4), a washer (5), a copper cap (6) and a second magnet (7) are arranged in such order and incorporated between said U-yoke (3) and voice coil (8);

A dust cap (18) mounted on a top of the diaphragm (9); and

A connector (1) for providing signal input is disposed on a side of the frame (2) and electrically connected with said voice coil (8); said bi-directional loudspeaker is characterized in that:

Said diaphragm (9) is in a cone shape whose a wider opening is facing downwardly and an apex penetrates a centre of the spider (15); an inner edge (10) of said apex is fixed with a top of said voice coil (8); a periphery (16) of the spider (15) is fixed with an upper locating hole (20) of the housing (19), and each lateral side of bottom thereof is fixed with an each side of exterior (11) of the diaphragm (9); Said spider (15), spacer (12) and diaphragm (9) are coupled by an adhesive and fixed on the top of said frame (2).

6. A bi-directional loudspeaker of claim 5, wherein said first magnet (4) and washer (5) are fitted into said copper cap (6) by having the washer (5) positioned on a top of the first magnet (4), and the second magnet (7) is disposed on a top of said copper cap (6).

7. A bi-directional loudspeaker of claim 5, wherein said first and second magnet (4, 7) are neodymium magnets (Nd-FeB magnet).

8. A bi-directional loudspeaker of claim 5, wherein an inner edge (17) of the spider (15) is jointed with said diaphragm (9).

* * * * *